United States Patent [19]

Seeger

[11] Patent Number: 4,687,339

[45] Date of Patent: Aug. 18, 1987

[54] INSTALLATION FOR THE DISPERSION OR EMULSIFICATION OF A MASS CONSISTING OF AT LEAST TWO PRODUCTS

[76] Inventor: Hanspeter Seeger, Sulzbachstr. 13, D-7801 Ballrechten Dottingen, Fed. Rep. of Germany

[21] Appl. No.: 721,556

[22] Filed: Apr. 10, 1985

[30] Foreign Application Priority Data

Apr. 11, 1984 [DE] Fed. Rep. of Germany ..... 3413675

[51] Int. Cl.[4] ..... B01F 5/06; B01F 7/00

[52] U.S. Cl. ..... 366/305; 366/303

[58] Field of Search ..... 366/304, 305, 303, 306, 366/307, 279, 176, 348, 349

[56] References Cited

U.S. PATENT DOCUMENTS 3,183,099 5/1965 Schultz ..... 366/305
3,194,540 7/1965 Hager ..... 366/305
3,195,867 7/1965 Mould ..... 366/305
4,416,548 11/1983 Carre ..... 366/305

*Primary Examiner*—Robert W. Jenkins
*Attorney, Agent, or Firm*—Wood, Dalton, Phillips, Mason & Rowe

[57] ABSTRACT

Improved dispersion or emulsification of a fluid medium of at least two components is obtained with an apparatus comprising a stator, a rotor journalled for rotation in close proximity to the stator and separated from the stator by a small gap, through passages in the rotor, a plurality of spaced inlets in the stator which open radially into the gap between the rotor and stator, and a means adjacent the rotor oppositely of the stator for collecting the dispersion or emulsification. There is at least one inlet in the stator for each of the components being dispersed or emulsified. The through passages in the rotor, the gap between the rotor and stator, and the inlets in the stator define at least one shearing field at the interface of the rotor and the stator.

11 Claims, 2 Drawing Figures

INSTALLATION FOR THE DISPERSION OR EMULSIFICATION OF A MASS CONSISTING OF AT LEAST TWO PRODUCTS

DESCRIPTION

1. Technical Field.

The invention is concerned with an apparatus for dispersion or emulsification of a fluid medium of at least two components.

2. Background Art.

The installation of the art is designed to mix a mass consisting of at least two products in a mixing chamber and then to disperse it in the region of shearingly cooperating tool collars. The tool collars are formed on a rotor and a stator, the shearing surfaces of which face each other and are separated by a small gap and have openings for transferring the mass. An installation of this type is described and illustrated in DE-OS No. 27 02 183.

The installation according to the art is not suitable for the dispersion or emulsification of products that undergo a change of phase, for example, a change in viscosity, and/or react in another way when they come into contact. The construction according to the state of the art is not suitable for the dispersion of emulsification of the latter products because, firstly, due to the reaction, homogeneous distribution of the components cannot be achieved and, secondly, portions of each component do not separate at all and later will appear as defect sites in the finished batch. One must take into consideration that the reactions occur at particle sizes of 1 micron produced in the shearing field.

The same problem arises in the emulsification of products with greatly differing viscosities, for example, silicone oil and water. As it is well know, silicone oil tends to build up extremely high viscosities upon exposure to a shearing field. As a result of this, due to the change in one of the properties of a product, obtaining a uniform dispersion or emulsion is difficult.

DISCLOSURE OF INVENTION

The apparatus of the invention is designed in such a way that even those products which tend to undergo a change of state upon mutual contact can be dispersed or emulsified.

One advantage of the invention is that the components are introduced through separate inlet channels which open directly into the shearing field. Thus, the products cannot react until they reach the shearing field. As a result, the dispersion or emulsification begins before the products undergo a change of stat due to mutual contact. Thus, the products can be reduced to a small size before this encounters substantial hindrance due to the change of state of the products.

The apparatus of the invention is advantageous for all dispersion processes in which there is a complete reaction between the participating phases and for all emulsification processes in which one or both phases can be moved only with difficulty in a free turbulence chamber since, at the required high flow velocities, they build up viscosities that do not permit exact mixing and colloidal distribution of the previous phase.

Earlier, from DE-OS No. 30 02 429, an installation has become known for dispersion in which separate inlet channels are provided for the introduction of various products, but this installation does not have a common shearing field for both products into which the inlet channels open directly. Moreover, the purpose of the conventional design is to mix poisonous or fluidizing powders, gases or fluids under the surface in such a way that they do not come into contact with the atmosphere.

In one form of the invention, the rotor and stator have collars which mesh like a comb forming two or more shearing fields, as a result of which the action of the device is increased significantly and the dispersion or emulsification is made more intense.

In one form of the invention, the inlet channels open radially outward into the shearing field and centrifugal force can be used to support the flow of the charge. This also allows the use of a plurality of inlets to charge each component to provide an even distribution of charge around the shearing field. Neither advantage can be obtained using inlet channels which open axially into the shearing field.

When the inlet channels are formed in the stator, additional inlet lines can be connected easily. However, it is also possible to form the inlet channels in the rotor. Therefore, in this case, complicated connections are necessary for the inlet lines. It is possible to design such a connection in the form of an annular groove which is closed with the aid of a rotatable slip ring which seals it, to which the inlet line is attached and which provides a continuous introduction of the product. This allows the rotor to rotate while the slip ring and the inlet lines connected to it remain stationary.

In one form of the invention a plurality of inlets for each component are arranged alternately and are spaced evenly around the periphery of the shearing field. Considerably more favorable prerequisites are created for the dispersion or emulsification process because small amounts of product enter into the shearing field per unit time in an alternately placed arrangement. A coarse preliminary size reduction is made possible by this form of the invention.

It is preferred to provide as large a number of inlets as possible.

A compact and space saving arrangement for the dispersion or emulsification of two components can be obtained by constructing the apparatus so that the inlet for the first component is formed by a central chamber in a stator from which at least one channel radially extends into the shearing field. The inlet for the second component is formed by a second chamber positioned radially outwardly of the central chamber and includes at least one further channel extending radially into the shearing field and spaced apart from the inlet for the first component. In addition, due to the arrangement of the chambers, which have an increased volume in comparison to the inlet channels and thus form a reservoir, the dosage in the inlet channels can be independent of the amount traversing the possible inlet lines. By providing additional chambers positioned radially outwardly of the central chamber and including at least one further inlet channel for each chamber extending radially into the shearing field and spaced apart from the other channels, a large number of products can be processed.

The dispersion or emulsification of components can be improved by designing the apparatus so that the openings in the rotor are wider than the openings in the stator. Due to the different cross-sections of the openings, the product stream is nonuniform, resulting in more intimate mixing and finer distribution.

An economical and space saving way of providing two shearing fields is to utilize a pot-shaped rotor with a hollow cylindrical wall which has openings bordering an annular groove in the stator. Additional shearing fields may be obtained by using a rotor and stator which have several collars.

In order to avoid adverse influence on the dosage of the amounts of products in the shearing field, free exit flow from the shearing field is necessary. This is made possible by utilizing a discharge means by which the shearing field opens into an annular chamber, preferably utilizing a radially extending connection for a discharge line. In this design, the charge can enter freely from the openings into the annular channel, from which it can be removed through a discharge line without any problems.

BEST MODE FOR CARRYING OUT THE INVENTION

Figure 1:
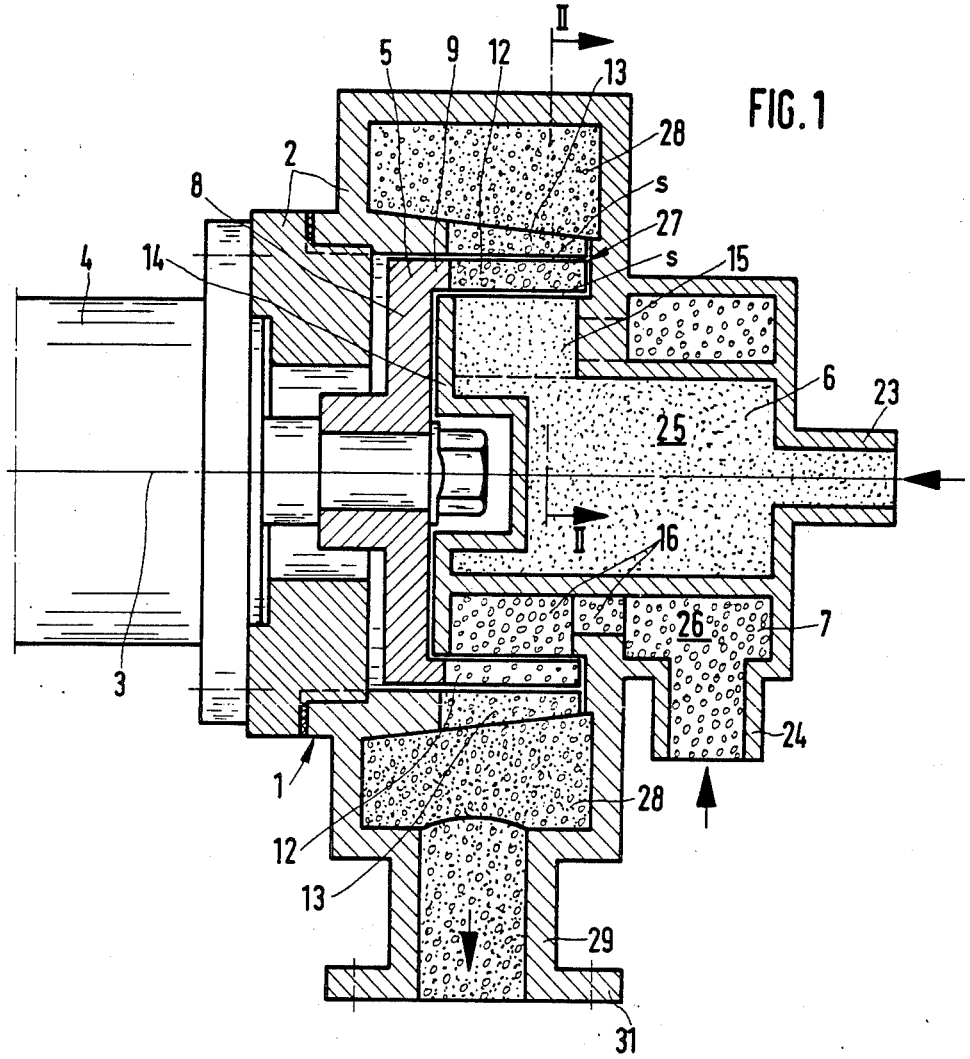
FIG. 1 is a cross-section through an apparatus according to the invention for the dispersion or emulsification of a fluid medium of two components.
Figure 2:
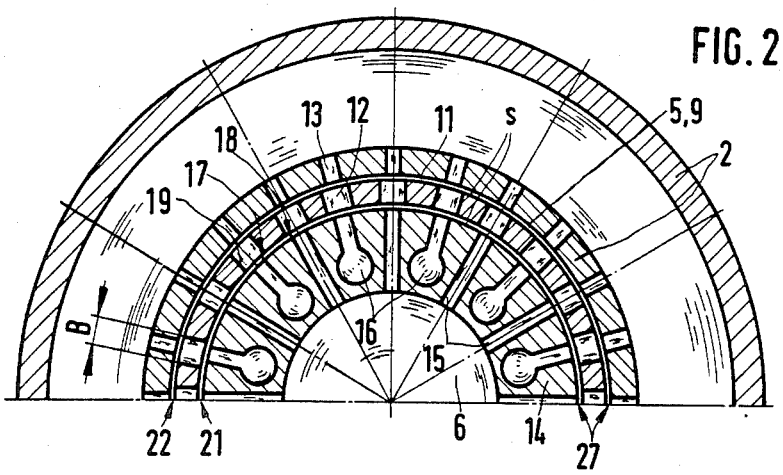
FIG. 2 is a section through the shearing field of the apparatus along line II—II in FIG. 1.

The apparatus which is generally designated by 1 in FIG. 1 consists of a housing or stator 2, a rotor 5 which can be rotated in stator 2 around rotary axis 3 with the aid of motor 4, and inlet channels 6, 7, separated from one another, for the introduction of two different components to be dispersed or emulsified.

Rotor 5 is formed in the shape of a pot and has a flange portion 8. A hollow cylindrical wall 9 juts out axially from the periphery of the flange portion 8. Wall 9 includes an annular groove 11 of stator 2, with play in its movement whereby achieved by gaps s formed on the inside and outside. Stator 2 and the hollow cylindrical wall 9 of the rotor 5 have a multiplicity of openings 12, 13 distributed on the periphery, preferably having a rectangular cross-section and extending radially and also lying o top of one another radially, so that when rotor 5 is rotated, the openings 12, 13 overlap alternatingly over a short period of time.

A multiplicity of radially extending connecting channels 15, 16 starting from inlet channels 6, 7 open in the area of openings 12, 13 from an extension 14 of stator 2 that borders pot-shaped rotor 5. These connecting channels are arranged alternatingly so that in the peripheral direction, a connecting channel 15 of inlet channel 6 follows a connecting channel 16 of inlet channel 7. The openings of these connecting channels are designated 17, 18.

The facing surfaces of stator 2 and rotor 5 form, with their edges 19, an inner shearing field 21 and an outer shearing field 22 in the region of the edges of the openings or edges of the inlets. These shearing fields have a cylindrical shape.

The products to be emulsified or dispersed are introduced through nozzles 23, 24 to which inlet lines (not shown), for example, tubings may be connected. Inlet channel 6 is formed by a centric, first chamber 25 of stator 2, from which the corresponding connecting channels 15 extend radially and to which the axially extending nozzles 23 are connected. Inlet channel 7 is formed a second chamber 26 which extends annularly around the first chamber 25 and to which the radial nozzles 24 are connected. Connecting channels 16 that start from the second chamber 26 extend first axially and then radially as described above.

When the installation is in operation, the two products, which are represented by small circles and by dots in order to distinguish them, are introduced first into the inner shearing field 21, through nozzles 23, 24, through inlet channels 6, 7 chambers 25, 26 and through connecting channels 15, 16, separately from each other. Since rotor 5 rotates relatively rapidly, the substances of the products are deformed, reduced in size and mixed intimately and distributed in one another intimately. The emulsified or dispersed charge arrives radially through openings 12 or rotor 5 into the external shearing field 22 where the charge is finally distributed and intimately mixed for a second time.

Shearing fields 21, 22 or annular gap s thus represent emulsifying and dispersion zones where optimum fine mixing and fine distribution of the product mass occurs.

The annular gaps s have very small dimensions and are designed in such a way that only layer thicknesses up to approximately 0.1 mm occur. Due to this design, the shearing rate can be correspondingly low, which leads to an enormous savings in energy and simultaneously to reliable and fine emulsification or dispersion.

In the emulsification or dispersion zones, which are generally designated 27, the product particles are represented as circles and dots, mixed with one another (FIG. 1).

In the region of annular chamber 28 of stator 2, the charge flows out from openings 13, the chamber representing a storage resevoir for the charge into which the charge can flow without disturbance. Outlet connections 29 extend radially from annular chamber 28 and this outlet connection may have flange 31 on its free end, which can serve advantageously for fastening of installation 1. The corresponding fastening screws are indicated by dash-dot lines.

INDUSTRIAL APPLICABILITY

Installation 1 is especially suitable for the dispersion or emulsification of products which undergo a change of state upon mutual contact, for example, react chemically or exhibit a change in viscosity. A substantial advantage of installation 1 consists in the fact that the products are introduced into separate inlet channels 6, 7 and come into contact only in emulsification or dispersion zone 27 or in shearing field 21. However, upon entry into shearing field 21, the substances are already deformed, reduced in size and are intimately mixed and finely distributed. As a result of this, the change of state of the substances does not occur before the emulsification or dispersion and therefore the change of state does not have any adverse effect on the mixing. On the other hand, in the case of products that react upon mutual contact, one can attain the advantage that the chemical reaction can occur when the substances are finer and are finely distributed and therefore the reaction can proceed to completion.

By providing additional inlet lines in a substantially equal relationship to the first and second inlet lines 6, 7, especially chambers 25, 26 and their openings 17, 18 in shearing field 21, more than two products can be processed in the same way.

Furthermore, rotor 5 and stator 2 may have several collars in such a way that the product can flow through several shearing fields in succession.

I claim:

1. Apparatus for dispersion or emulsification of a fluid medium of at least two components comprising:

a stator;

a rotor journalled for rotation in close proximity to said stator and separated therefrom by a small gap;

through passages in said rotor;

a plurality of spaced inlets in said stator and opening radially to said gap, there being at least one inlet for each of said components;

said through passages, said gap and said inlets defining at least one shearing field at the interface of said rotor and stator; and means adjacent said rotor oppositely of said stator for collecting said dispersion or emulsification.

2. The apparatus of claim 1 wherein said stator is located radially inwardly of said rotor and said inlets open radially outwardly.

3. The apparatus according to claim 2 wherein the inlet for one of said components is formed by a central chamber in said stator from which at least one channel radially extends to said gap and the inlet for another component is formed by a chamber radially outwardly of the central chamber and includes at least one further channel extending radially to said gap and spaced from said one channel.

4. The apparatus of claim 1 wherein said gap has a width on the order of 0.1 mm.

5. The apparatus of claims 1, 2 or 4 wherein there are a plurality of said inlets for each of said components, the inlets for one component alternating with the inlets for the other component(s) about said gap.

6. Apparatus for dispersion or emulsification of a fluid medium of at least two components comprising:

a stator with spaced, concentric surfaces;

a rotor journalled for rotation in close proximity to said stator between said concentric surfaces, and being separated therefrom by small gaps;

through passages in said rotor;

a plurality of spaced inlets in one of said stator surfaces and opening into said gaps, there being at least one inlet for each of said components;

said through passages, said gaps and said inlets defining two or more shearing fields at the interfaces between said rotor and said stator surfaces; and means for collecting said dispersion or emulsification.

7. The apparatus of claim 6 wherein said inlets open radially into said gaps;

8. The apparatus of claim 6 wherein one of said stator surfaces is located radially inwardly of said rotor and said inlets are located in said one stator surface and open radially outwardly.

9. The apparatus according to claim 8 wherein the inlet for one of said components is formed by a central chamber in said stator from which at least one channel radially extends to said gaps and the inlet for a second component is formed by a chamber radially outwardly of the central chamber and includes at least one further channel extending radially to said gaps and spaced from said one channel, and the inlet for each additional component is formed by a corresponding additional chamber radially outwardly of the central chamber and includes at least one further channel extending radially to said gaps and spaced from said other channels.

10. The apparatus of claim 6 wherein said gaps have widths on the order of 0.1 mm.

11. The apparatus of claims 6, 7, or 8 wherein there are a plurality of said inlets for each of said components, the inlets for one component alternating with the inlets for the other component(s) about said gaps.

* * * * *